United States Patent [19]

Ji

[11] Patent Number: 5,069,261

[45] Date of Patent: Dec. 3, 1991

[54] COIN HOLDING DEVICE

[76] Inventor: Bryan Ji, 265 E. Armitage, Elmhurst, Ill. 60126

[21] Appl. No.: 661,876

[22] Filed: Feb. 27, 1991

[51] Int. Cl.[5] ..... A45C 1/00

[52] U.S. Cl. ..... 150/150; 206/0.82; 383/49

[58] Field of Search ..... 206/0.8, 0.82; 150/150; 383/49

[56] References Cited

U.S. PATENT DOCUMENTS

| | | | |
|---|---|---|---|
| 496,610 | 5/1893 | Hurlbut | 206/0.82 X |
| 925,454 | 6/1909 | Burrows | 383/49 X |
| 1,600,633 | 9/1926 | Hildebrand | 150/150 |
| 2,553,081 | 5/1951 | Cohen . | |
| 2,569,629 | 10/1951 | Everitt . | |
| 3,063,487 | 11/1962 | Mullin | 150/150 |
| 3,160,186 | 12/1964 | Conley | 150/150 X |
| 3,272,248 | 9/1966 | O'Farrell | 150/150 X |
| 4,184,590 | 1/1980 | Tenbrink | 206/0.82 |
| 4,781,290 | 11/1988 | Oliphant | 206/0.83 |
| 4,874,348 | 10/1989 | Lafreniere . | |

*Primary Examiner*—William I. Price

*Attorney, Agent, or Firm*—Laff, Whitesel, Conte & Saret

[57] ABSTRACT

A coin holding device comprises a pair of generally rectangular resilient wall members, at least one of which is preferably transparent. The two flexible walls are secured to one another along three perimeter edges. The remaining perimeter edge is unsecured. An inner flexible transparent pouch for holding coins and the like is contained within the wall members. The front end of the pouch has gently curved front walls leading to an opening through which coins may be inserted and removed. A pair of resilient flaps extends inwardly from the unsecured edges of the flexible walls. The flaps are joined along a central seam. A small relieved region in each flap forms an aperture in the central seam. The opening of the flexible pouch is joined to the flaps at the aperture. Absent pressure from a user, the resilient wall members remain flat and hold the coin aperture closed. By applying pressure to the perimeter edges of the walls, a user may cause the walls to bow outward, thereby opening the coin aperture to permit coins to be inserted and removed. The inventive card-shaped coin holder is simple, inexpensive light-weight, and generally flat, and is small enough to fit in a user's wallet, purse or clothing pocket.

16 Claims, 3 Drawing Sheets

COIN HOLDING DEVICE

BACKGROUND OF THE INVENTION

The present invention relates generally to devices for holding specific coins so they are conveniently stored and yet readily accessible for use, and more particularly to coin holders carried in a user's wallet, purse or clothing pocket so that a user frequently needing a specific coin can find that coin immediately.

In the past, users have retained coins in devices generally taking the form of a purse or similar container providing some sort of closure means. One problem with such prior art coin holders is that when a user requires a specific coin, the search for that coin among the other coins inside the purse may be extremely inconvenient and can cause annoying delay for the user. For example, in locales where a special coin-like token is required to use buses, trains or other transit facilities, it is desireable to have the token available when boarding or passing a fare collection turnstyle. Because the token may be similar in size, shape, and color to other coins, it may be difficult for some users to easily and quickly distinguish tokens from other coins in the prior-art purse-type coin holders. In addition, since the tokens may have much higher value than ordinary coins, it is highly desireable to avoid inadvertently using the tokens when ordinary coins are required.

An additional problem with prior-art purse-type coin holders is that the holder allows coins to move freely within the purse. Consequently, the coins can create rattling noises when the purse is carried by the user.

Prior art solutions of which I am aware have generally included spring-loaded coin containers or cylindrical coin holding devices. However, such devices are inconveniently bulky to carry.

OBJECTS AND SUMMARY OF THE INVENTION

It is therefore an object of the present invention to provide an apparatus for conveniently storing specific needed coins which can be quickly accessed and dispensed.

It is another object of the invention to provide a coin holder which may be constructed simply and inexpensively, and which is sufficiently small, flat, and light in weight to be conveniently carried in a user's wallet, purse or clothing pocket.

It is a further object of the invention to provide a coin holding apparatus which resiliently opposes movements of coins held therein to avoid the problem of rattling coins.

A coin holding device according to the present invention comprises a pair of generally rectangular resilient wall members, at least one of which is preferably transparent. The two flexible walls are secured to one another along three perimeter edges. The remaining perimeter edge is unsecured. An inner flexible transparent pouch for holding coins and the like is contained within the wall members. The front end of the pouch has gently curved front walls leading to an opening through which coins may be inserted and removed. A pair of resilient flaps extends inwardly from the unsecured edges of the flexible walls. The flaps are joined along a central seam. A small relieved region in each flap forms an aperture in the central seam. The opening of the flexible pouch is joined to the flaps at the aperture. Absent pressure from a user, the resilient wall members remain flat and hold the coin aperture closed. By applying pressure to the perimeter edges of the walls, a user may cause the walls to bow outward, thereby opening the coin aperture to permit coins to be inserted and removed. The inventive card-shaped coin holder is simple, inexpensive, light-weight, and generally flat, and is small enough to fit in a user's wallet, purse or clothing pocket.

BRIEF DESCRIPTION OF THE DRAWINGS

These and other features of this invention will be best understood by reference to the following detailed description of a preferred embodiment of the invention, taken in conjunction with the accompanying drawings, in which.

DETAILED DESCRIPTION OF THE PREFERRED EMBODIMENT

Figure 1:
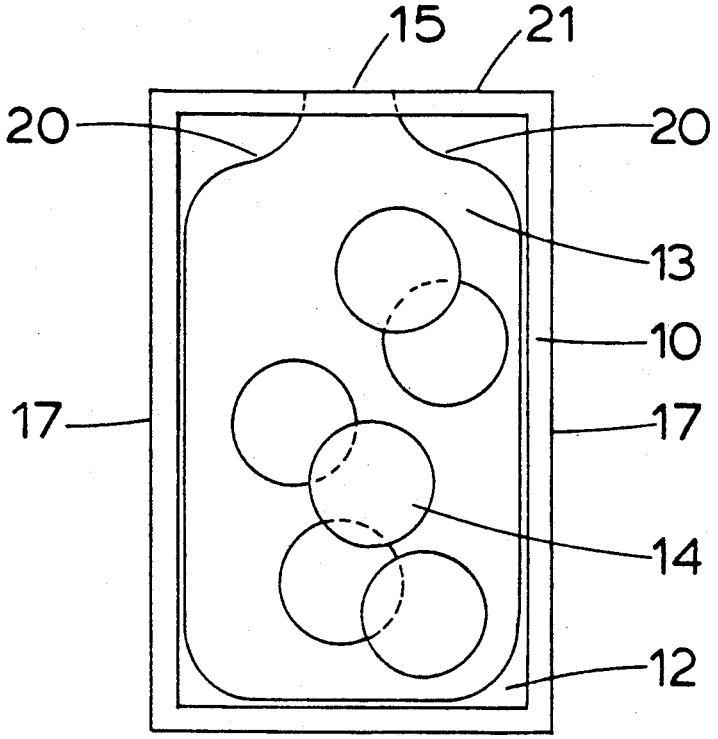
FIG. 1 is a plan view of a coin holding device constructed according to the present invention.

Referring now to FIGS. 1–5, there is shown a preferred embodiment of a coin holder 10 constructed according to the present invention. The coin holder 10 has front and back flexible rectangular walls 11 and 12. At least one of the walls 11, 12 is preferably transparent to reveal the contents of the holder. As shown in the drawings, the back wall 12 is transparent. The two walls 11, 12 are secured together along the perimeter edges 17 leaving at least one of the shorter edges 21 unsecured. A transparent pouch 13 having an opening 15 is contained between the two walls 11, 12.

Figure 2:
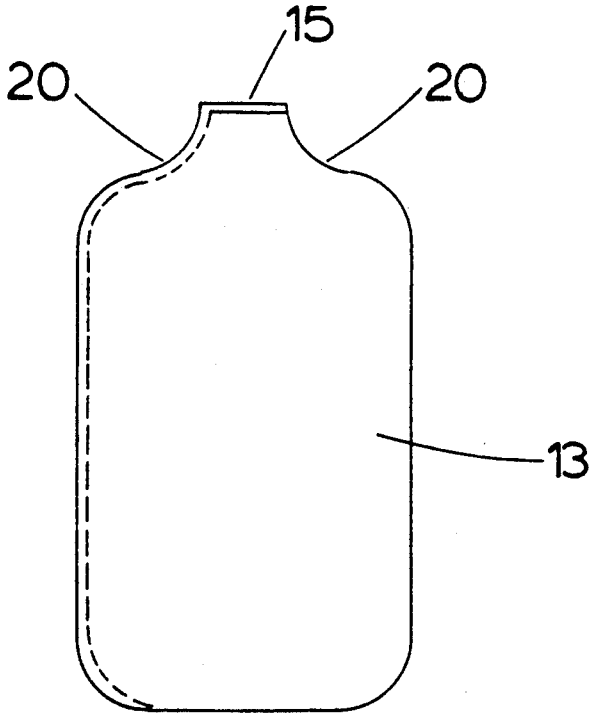
FIG. 2 is an isolated plan view of a coin pouch which is disposed within a casing of the device of FIG. 1; constructed in between the casing.

As most clearly shown in FIG. 2, the thin pouch 13 preferably has gently curved front walls 20 to funnel coins 14 towards opening 15. As most clearly shown in FIGS. 4–5, a pair of resilient flaps 16 are attached to the unsecured front edges 21 of walls 11, 12. The flaps meet and are partially joined along a central seam 18. Each flap has a small relieved region 19 on its inner edge in which the flap is free of the remaining flap. The relieved regions 19 of the two flaps coincide to form an aperture, and the transparent pouch 13 is attached to the flaps 16 at opening 15. Thus, the aperture created in the flaps 16 by the relieved regions 19 cooperates with opening 15 to permit objects of an appropriate size to travel into or out of the transparent pouch.

Figure 3:
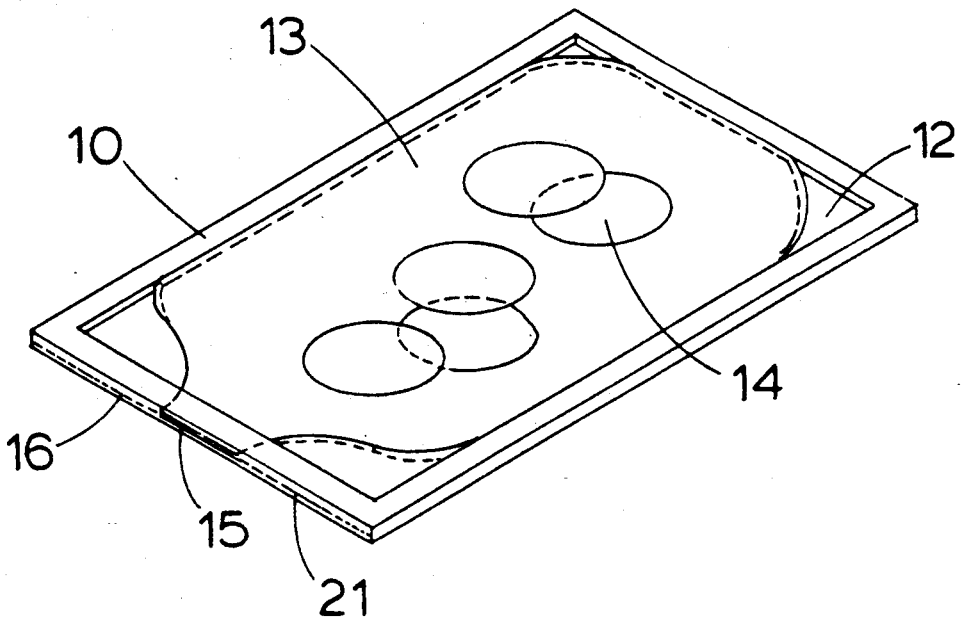
FIG. 3 is a perspective view of the device of FIGS. 1–2 in a closed position.

FIG. 3 is a perspective view of present invention in the closed position. Walls 11, 12 are flat. Flaps 16 are bent inward and lie flat, giving the coin holder a thin profile. The edges of opening 15 are held adjacent to one another, thereby securing coins 14 contained inside the coin holder 10.

Figure 4:
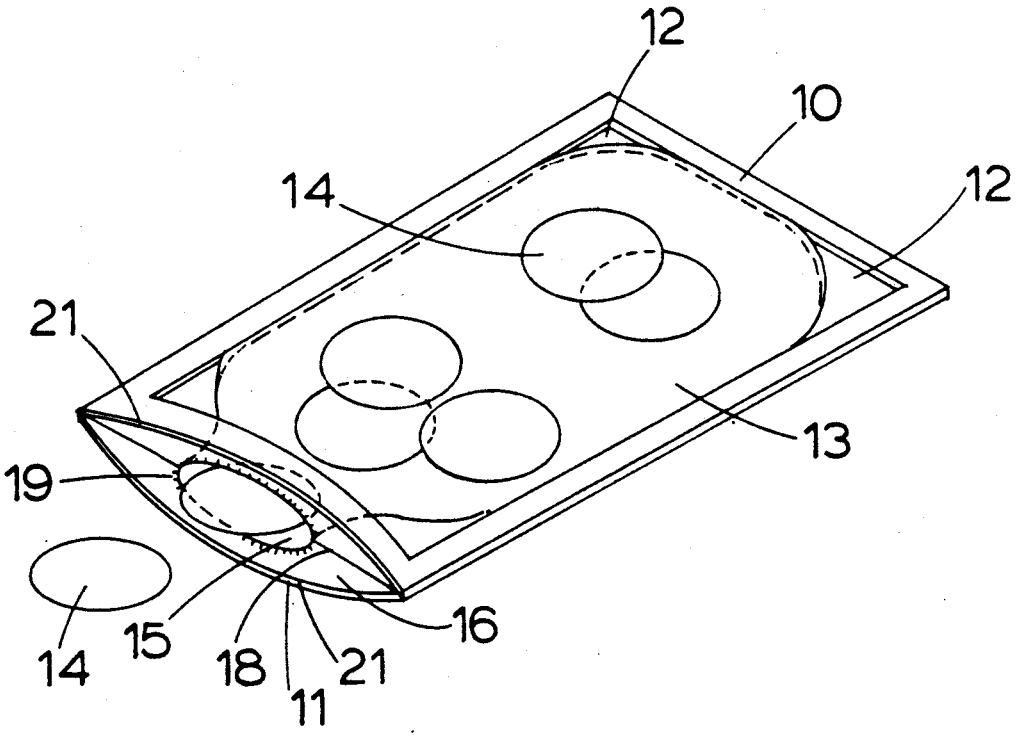
FIG. 4 is a perspective view of the device of FIGS. 1–3 in an open position.

FIG. 4 is a perspective view of present invention in an open position in which the walls are flexed. In the open position, the flaps are held in tension by the front edges 21 of walls 11, 12 and are substantially perpendicular to the walls 11, 12. The resilient flaps 16 limit the degree to which walls 11, 12 may flex. In the open position, the edges of opening 15 are separated to allow coins to be inserted and dispensed from the coin holder.

Figure 5:
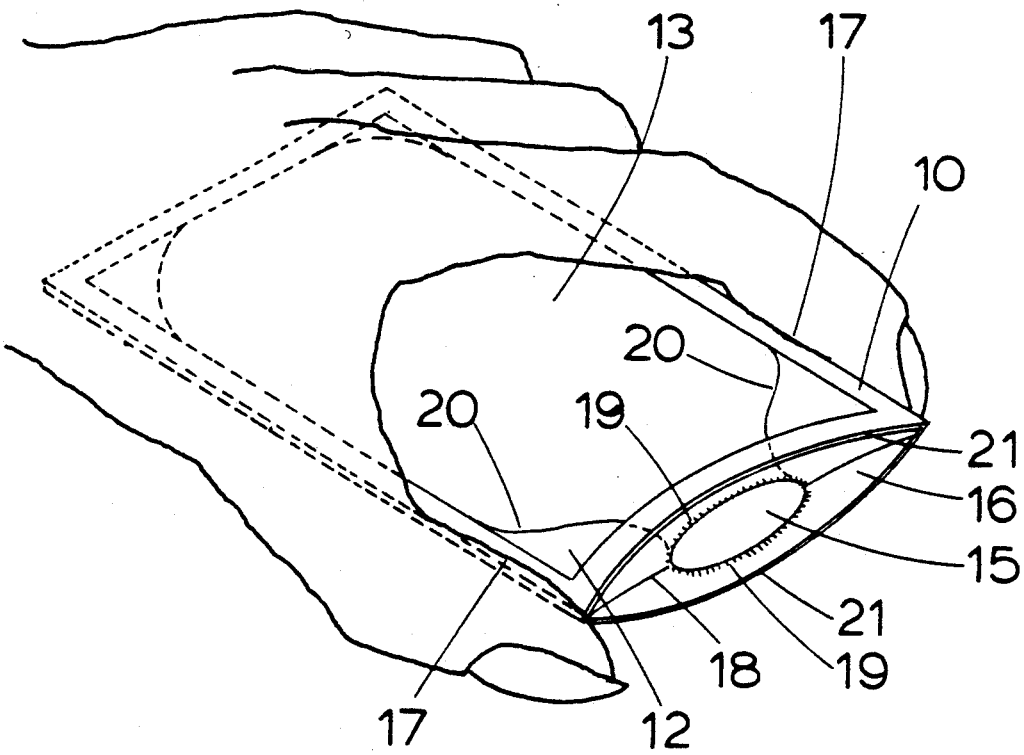
FIG. 5 is an isometric view showing the device of FIGS. 1–4 in an open position.

As best illustrated in FIG. 5, the thin pouch converges partially in the region about opening 15 to restrict free movement of coins 14 through the opening 15 in either loading or dispensing.

In operation, a user may open the coin holder 10 for dispensing or insertion of coins by applying pressure along the elongated edges 17, as best seen in FIG. 5. The flexible walls 11, 12 bend, repelling each other, to allow the edges of the opening 15 of pouch 13 to be separated. To dispense coins already contained in the coin holder, the user may urge coins toward the opening 15 by tilting or shaking the coin holder. The user may observe the position and number of coins through transparent wall 12, as shown in FIGS. 1, 3, 4, and 5. FIG. 3 illustrates the completed construction containing coins 14 to be generally flat.

The coin holder may be constructed of any appropriate material, but it is preferable that the materials be highly durable and remain resilient even after extensive use. In particular, the materials from which the walls 11, 12 are constructed should be highly resistent to loss of elasticity, because it is important that opening 15 be completely closed when not held in the flexed position by the user.

While the inventive coin holder has been described herein as having substantially rectangular walls 11, 12, it could also be constructed having walls of any other appropriate shapes provided that the walls may flex or bow outward in opposite directions. For example, the walls 11, 12 could be constructed as three-or five-sided polygons, circles, elipses, or any other appropriate shape. The walls should remain unjoined for at least a portion of their perimeters to accommodate flaps 16 and opening 15.

The above-described embodiment of the invention is merely one example of a way in which the invention may be carried out. Other ways may also be possible, and are within the scope of the following claims defining the invention.

I claim:

1. A coin holder apparatus comprising two flexible rectangular walls, each wall having two elongated edges and two shorter edges; said walls being secured together along said elongated edges so that said shorter edges will bend to create a chamber between said walls in response to pressure applied along said elongated edges; and a pouch disposed between said walls with an opening to enable access to the interior of the pouch.

2. The coin holder of claim 1 where said walls are parallel in a closed position and exert a resilient force on said pouch in said closed position to preclude movement of coins contained in said pouch and to close said pouch opening.

3. The coin holder as defined in claim 1 wherein said pouch is shaped to prevent any coins contained in said pouch from becoming stuck in said holder and to keep said coins parallel to said walls.

4. The coin holder of claim 1 wherein one of said walls and said pouch are transparent.

5. The coin holder of claim 1 wherein said walls and pouch are relatively flat and are shaped like a credit card.

6. A device for holding thin objects comprising:

first and second adjacent substantially parallel resilient members operatively associated with each other;

means disposed between said members for containing thin objects;

said members being responsive to flexing by a user to bow outward in opposite directions; and said object containing means having an aperture responsive to the bowing of said members to enable insertion and removal of said objects when said members are flexed.

7. The device of claim 6 wherein at least one of said members is transparent.

8. The device of claim 6 wherein said members are formed as substantially planar sheets having four perimeter edges and said members are joined along at least two of said edges.

9. The device of claim 6 wherein said members are formed as substantially planar sheets having a predefined number of perimeter edges and said members are joined along at least one perimeter edge.

10. The device of claim 6 wherein said members are formed as substantially planar sheets having one or more perimeter edges and said members are joined at at least two points along said perimeter edges.

11. The device of claim 6 wherein said object containing means comprises a pouch having an aperture.

12. The device of claim 6 further comprising means for limiting the extent of flexing of said members.

13. The device of claim 6 further comprising means attached to said members for opening and closing said aperture as said members are flexed.

14. The device of claim 6 further comprising first and second members each having an opposing peripheral edge; a resilient flap attached to each opposing peripheral edge of said members; each of said flaps having an edge adjoining an edge of the other flap; said adjoining edges of said flaps having a sealed portion and an unsealed portion; said unsealed portion cooperating to define an opening.

15. The device of claim 14 wherein said object containing means comprises a pouch joined to said opening to permit movement of objects into and out of said pouch through said aperture.

16. The device of claim 14 wherein said resilient flaps extend inwardly between and substantially parallel to said members when said members are not flexed by a user; and said resilient flaps extend at an angle with respect to said members when said members are flexed by a user.

* * * * *